United States Patent [19]

Jones et al.

[11] Patent Number: 4,949,905

[45] Date of Patent: Aug. 21, 1990

[54] SPRINKLER HEAD MOUNTING SYSTEM

[75] Inventors: Gregory A. Jones, 40498 Hwy. 59, Yuma, Colo. 80759; Dale D. Anderson, Yuma, Colo.

[73] Assignee: Gregory A. Jones, Yuma, Colo.

[21] Appl. No.: 237,524

[22] Filed: Aug. 26, 1988

[51] Int. Cl.[5] ..... B05B 15/06; E02B 13/00

[52] U.S. Cl. ..... 239/279; 239/273; 405/41

[58] Field of Search ..... 405/36, 39, 40, 41; 239/273, 275, 276, 279, 285, 542; 285/5

[56] References Cited

U.S. PATENT DOCUMENTS

| | | | |
|---|---|---|---|
| 619,189 | 2/1899 | Kitzing | 239/273 |
| 912,493 | 2/1909 | Sanders | 239/273 X |
| 1,389,319 | 8/1921 | Quigley | 405/41 |
| 3,734,545 | 5/1973 | Stout | 285/5 |

FOREIGN PATENT DOCUMENTS

| | | | |
|---|---|---|---|
| 8402916 | 4/1986 | Netherlands | 239/273 |

*Primary Examiner*—David H. Corbin

*Attorney, Agent, or Firm*—Dean P. Edmundson

[57] ABSTRACT

Sprinkler head mounting system for connecting a sprinkler head to a horizontal water supply pipe in an irrigation system (e.g., an agricultural irrigation system). In one embodiment the mounting system includes (a) a U-shaped tubular member connected to the water supply pipe, (b) a flexible tubular member coupled to the U-shaped member, (c) a conduit having inlet and outlet portions, (d) a riser connected to the outlet portion of the conduit, and (e) a counter-weight carried by the conduit for balancing the weight of the riser and sprinkler head. The mounting system prevents vibration from the sprinkler head from being transmitted to the water supply pipe.

9 Claims, 1 Drawing Sheet

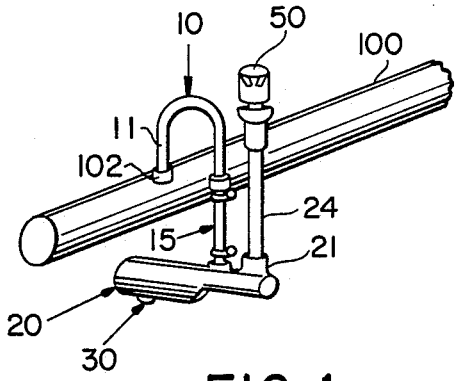
FIG. 1
FIG. 2
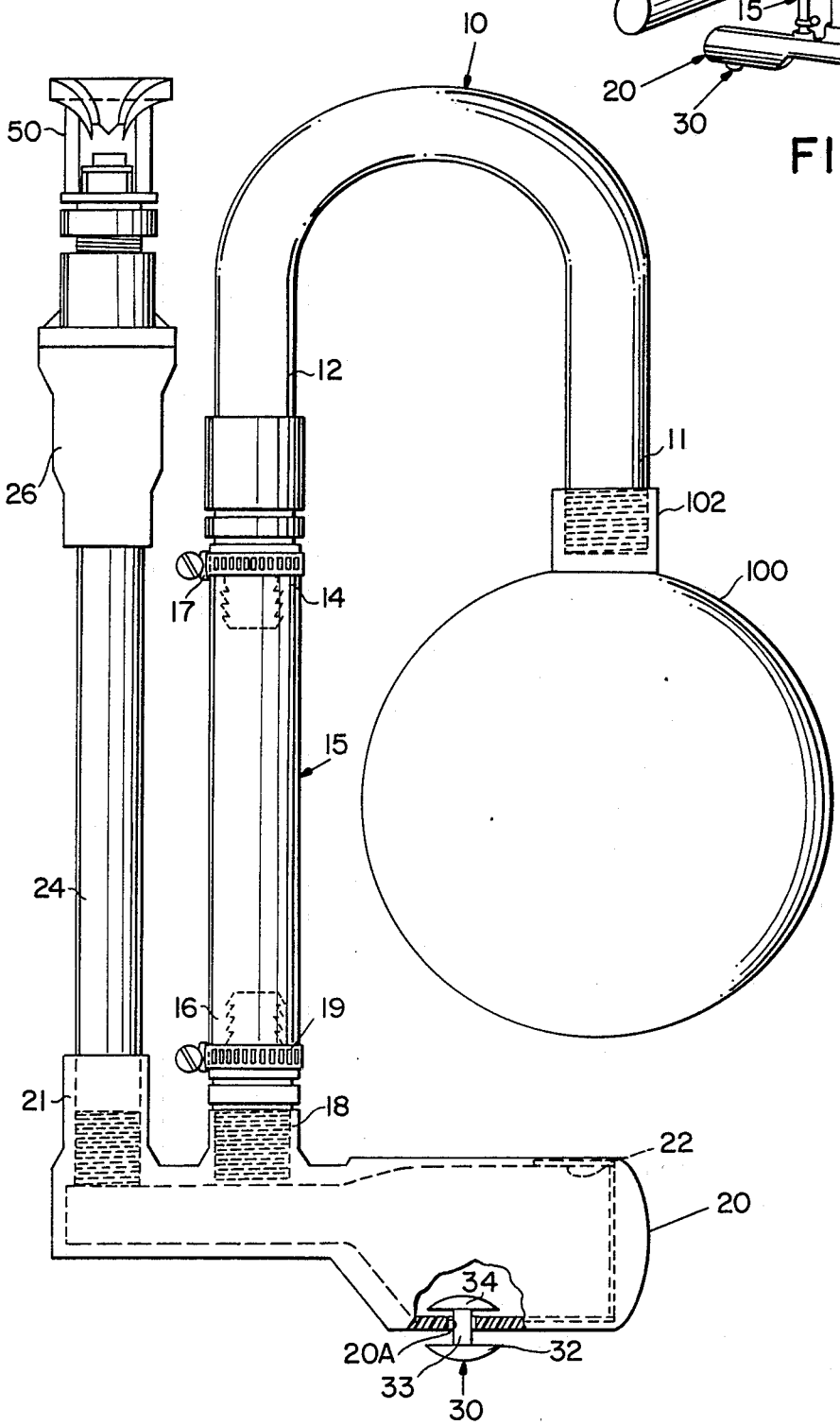

SPRINKLER HEAD MOUNTING SYSTEM

FIELD OF THE INVENTION

This invention relates to agricultural sprinkler systems. More particularly, this invention relates to center pivot and overhead agricultural sprinkler systems. Even more particularly, this invention relates to systems for mounting sprinkler heads on agricultural irrigation systems.

BACKGROUND OF THE INVENTION

Agricultural sprinkler systems are quite popular and often very necessary in agricultural operations in many areas of the United States as well as in certain foreign countries. A very popular type of irrigation system which is commonly used is a center pivot system in which a long horizontally disposed sprinkler boom or pipe extends outwardly from a well. A large motor and pump supply water to one end of the pipe and force the water through it. At various locations along the pipe there are exit ports to allow a certain amount of the water to exit.

A sprinkler head is operably connected to each exit port to spray the water or distribute it as it exits the horizontal pipe. Typically the exit ports are on the top side of the horizontal pipe so as to alleviate problems with sediment (e.g., sand, mineral deposits, scale, etc.) plugging the exit ports.

There are a number of different types of sprinkler heads which are commercially available for use on such horizontal sprinkler systems. Different types of sprinkler heads produce different types of spray patterns for the water as it exits the supply pipe.

One type of sprinkler head produces a particularly desirable type of spray pattern in which the water simulates rainfall with large drops. For example, this type of sprinkler head is commercially available from Senninger Irrigation Co. and is referred to as a Wobbler. It includes a head portion which rotates and wobbles at the same time when used on a sprinkler irrigation system. This type of head produces a very uniform water pattern which virtually eliminates compaction of soil and run-off of excess water which often results when using other types of sprinklers which allow numerous droplets of water to strike the ground at the same spot in rapid succession.

The main disadvantage associated with the use of these wobbler heads is that they cause severe vibration of the sprinkler apparatus. On certain brands of center pivot sprinklers this vibration can become harmonious and travel back and forth throughout the apparatus. Within several hours a truss component can fatigue and break, allowing a span of lateral pipe to fall and destroy portions of the apparatus and certain of the crops below it.

Some agricultural irrigation systems have very long spans of horizontal sprinkler pipe and may utilize more than 100 sprinkler heads. Thus, vibration caused by the sprinkler heads is especially dangerous when it becomes harmonic. Even if it does not become harmonic, long-term vibration can cause metal fatigue and failure of various components.

There has not heretofore been provided a safe, effective, easy-to-use, and reliable means for avoiding the vibration caused by sprinkler heads on large agricultural sprinkler systems.

SUMMARY OF THE PRESENT INVENTION

In accordance with the present invention there is provided a mounting system for connecting a sprinkler head to a horizontal water supply pipe in an irrigation system. In a preferred embodiment the mounting system comprises:

(a) a U-shaped tubular member having first and second ends, wherein the first end is adapted to be operably secured to the supply pipe in a manner such that water flows into the first end of the tubular member;

(b) a flexible tubular member having first and second ends, wherein the first end is coupled to the second end of the U-shaped tubular member and receives water flowing through the U-shaped member;

(c) a tubular riser having upper and lower ends, wherein the sprinkler head is adapted to be operably secured to the upper end;

(d) conduit means having an inlet portion operably connected to the second end of the flexible tubular member and an outlet portion operably connected to the lower end of the riser, (e) a counter-weight carried by the conduit means and extending horizontally outwardly therefrom, the counter-weight being adapted to balance the weight of the riser and the sprinkler head in a manner such that the riser is maintained in a generally vertical plane.

Preferably the counter-weight comprises a body member having an internal cavity which communicates with the flexible tubular member and the tubular riser. The cavity then fills with water to add the necessary weight to counter-balance the riser and the sprinkler head. The water in the cavity also serves to dampen vibration created by the sprinkler head.

The mounting system of this invention is particularly suited for the mounting of sprinkler heads of the type which wobble during normal operation. For example, popular sprinkler heads of this type include the Senninger wobbler sprinkler head which wobbles and rotates at the same time. The novel mounting system prevents the vibration created by these sprinkler heads from being transmitted to the horizontal water supply pipe and the supporting towers.

The mounting system of this invention is also useful for mounting any other type of sprinkler heads which create vibration during normal operation. Additional advantages of the mounting system of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which:

FIG. 1 is a perspective view illustrating use of the system of the invention on an overhead agricultural irrigation system;

FIG. 2 is a side elevational view of a preferred embodiment of mounting system of the invention.

DETAILED DESCRIPTION OF THE INVENTION

In the drawings there is illustrated one embodiment of a mounting system for connecting a sprinkler head 50 to a horizontal water supply pipe 100 in an irrigation system. The mounting system includes a U-shaped tubular member 10 operably connected at end 11 to an exit port 102 on the upper side of water supply pipe 100. The opposite end 12 is connected to end 14 of a flexible tube or hose 15 by means of clamp 17.

The lower end 16 of tube or hose 15 is connected to the inlet portion 18 of body member 20 (e.g., by means of clamp 19). Tubular riser 24 is connected at its lower end to the outlet 21 of body member 20. At the upper end of riser 24 there is operably connected a pressure regulator 26. Sprinkler head 50 is operably connected to the upper end of the pressure regulator, as illustrated.

The body member 20 includes an internal cavity 22, as illustrated. The cavity communicates with both the inlet portion 18 and the outlet portion 21.

Water from the horizontal water supply pipe 100 flows through U-shaped member 10 and flexible tubular member 15 into cavity 22 before it exits portion 21. The water which remains in the cavity 22 serves as a counter-weight to balance the weight of riser pipe 24, pressure regulator 26, and sprinkler head 50.

The water in cavity 22 and the flexible nature of tube 15 serve to dampen the vibration exhibited by the sprinkler head 50 during operation. This prevents the undesirable vibration from being transmitted to the horizontal water supply pipe 100.

The diameter of the water supply pipe 100 may vary (e.g., from about 2 inches to 10 inches or even more).

The diameter of the flexible hose or tube 15 may vary, depending upon water flow requirements. Commonly the diameter is in the range of about 0.5 to 1 inch. The length of hose 15 may also vary. Typically it is in the range of about 2 inches to 2 feet.

The flexible hose 15 may be composed of rubber or plastic (e.g., polyvinylchloride) which is durable and flexible. It must be capable of withstanding exposure to sunlight, moisture, and vibration without cracking or breaking.

The body member 20 which serves as a counter-weight for the weight of riser pipe 24 preferably is oriented in a horizontal or transverse direction, as illustrated in the drawings. The cavity in the large portion of the body member is sufficiently large that it can hold sufficient water to counter-balance the weight of the riser pipe 24, pressure regulator 26, and head 50.

Preferably body member 20 is an integral unit and may be made by injection molding, for example, with appropriate openings 18 and 21 for inlet and outlet of water. Preferably body 20 is composed of durable plastic.

It is also preferably for body 20 to be self-draining. This feature may be provided as illustrated in the drawings. The lower wall of the body 20 includes an opening 20A, and the lower wall is also curved (e.g., the body 20 is preferably cylindrically shaped).

A plug member 30 includes head members 32 and 34 attached to opposite ends of shank 33. At least head 34 is composed of flexible rubber or other deformable materials so that head 34 can be forced through opening 20A which is smaller than head 34. The base of head 34 is flat or planar, as illustrated, and is preferably circular in cross-section.

Because the interior wall of the body member 20 is curved, the base of head 34 does not fit flush with the interior wall of body 20 unless there is sufficient water pressure in the cavity in body 20 to force the base of head 34 against the interior wall. In other words, unless there is sufficient water pressure in body 20 the resilient nature of head 34 causes the head 34 to move away from the interior wall of body 20 slightly so as to allow water in the body 20 to exit or drain through opening 20A. This feature avoids the need to manually drain each body 20 in an irrigation system.

Other variants are possible without departing from the scope of this invention. For example, the riser pipe 15 may be composed of steel or plastic so long as it is capable of supporting the sprinkler head 50 and pressure regulator 26 (if a regulator is used at all). The pressure regulator is preferably used, but if the pressure of the water in pipe 100 and riser pipe 24 is already suitable for the sprinkler head being used, then a pressure regulator is not required. The diameter and length of riser pipe 15 may vary, as desired.

The mounting system of the invention is especially useful for mounting sprinkler heads to conventional center pivot irrigation systems. However, the mounting system can also be used for mounting sprinkler heads to any type of horizontal sprinkler pipes.

What is claimed is:

1. A sprinkler head mounting system for connecting a sprinkler head to a horizontal water supply pipe in an irrigation system, said mounting system comprising:

(a) a U-shaped tubular member having first and second ends, wherein said first end is adapted to be operably secured to said supply pipe in a manner such that water flows into said first end of said tubular member;

(b) a flexible tubular member having first and second ends, wherein said first end is coupled to said second end of said U-shaped tubular member and receives water flowing through said U-shaped member;

(c) a tubular riser member having upper and lower ends, wherein said sprinkler head is adapted to be operably secured to said upper end;

(d) conduit means having an inlet portion operably connected to said second end of said flexible tubular member and an outlet portion operably connected to said lower end of said riser, (e) a counter-weight carried by said conduit means and extending horizontally outwardly therefrom, said counter-weight being adapted to balance the weight of said riser and said sprinkler head in a manner such that said riser is maintained in a generally vertical plane; wherein said counter-weight comprises a body member having a cavity therein which communicates with said conduit means, wherein said cavity is adapted to become filled with water when said irrigation system is operating.

2. A system in accordance with claim 1, wherein said flexible tubular member comprises a length of plastic hose.

3. A system in accordance with claim 1, wherein said body member includes an opening to enable said cavity to be drained.

4. A system in accordance with claim 3, further comprising a plug adapted to close said opening in said cavity in response to water pressure in said cavity and being further adapted to open said opening when said cavity is not pressurized.

5. In combination with an irrigation system of the type including a horizontal water supply pipe having a plurality of water exit ports spaced therealong, the improvement which comprises a sprinkler head mounting system for connecting sprinkler heads to said supply pipe, wherein said mounting system for each such sprinkler head comprises:

(a) a U-shaped tubular member having first and second ends, wherein said first end is operably connected to one of said exit ports on said supply pipe in a manner such that water flows into said tubular member;

(b) a flexible tubular member having first and second ends, wherein said first end is coupled to said second end of said U-shaped tubular member and receives water flowing through said U-shaped member;

(c) tubular riser having upper and lower ends, wherein said sprinkler head is adapted to be operably secured to said upper end;

(d) conduit means having an inlet portion operably connected to said second end of said flexible tubular member and an outlet portion operably connected to said lower end of said riser, (e) a counter-weight carried by said conduit means and extending horizontally outwardly therefrom, said counter-weight being adapted to balance the weight of said riser and said sprinkler head in a manner such that said riser is maintained in a generally vertical plane; wherein said counter-weight comprises a body member having a cavity therein which communicates with said conduit means, wherein said cavity is adapted to become filled with water when said irrigation system is operating.

6. The improvement in accordance with claim 5, wherein said flexible tubular member comprises a length of plastic hose.

7. The improvement in accordance with claim 5, wherein said body member includes an opening to enable said cavity to be drained.

8. The improvement in accordance with claim 7, further comprising a plug adapted to close said opening in said cavity in response to water pressure in said cavity and being further adapted to open said opening when said cavity is not pressurized.

9. The improvement in accordance with claim 5, further comprising a pressure regulator operably connected between said upper end of said riser and said sprinkler head.

* * * * *